US006951475B2

(12) United States Patent
Silva

(10) Patent No.: US 6,951,475 B2
(45) Date of Patent: Oct. 4, 2005

(54) CABLE STRAIN RELIEF DEVICE

(75) Inventor: David Silva, Neckartenzlingen (DE)

(73) Assignee: Hirschmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/656,108

(22) Filed: Sep. 8, 2003

(65) Prior Publication Data

US 2004/0077211 A1 Apr. 22, 2004

(30) Foreign Application Priority Data

Sep. 9, 2002 (DE) ..... 102 41 650

(51) Int. Cl.[7] ..... H01R 13/58
(52) U.S. Cl. ..... 439/449; 439/67; 439/499
(58) Field of Search ..... 439/449, 404–405, 439/358, 456–460, 470–473, 465, 331, 345, 373, 567, 571, 573, 499

(56) References Cited

U.S. PATENT DOCUMENTS 3,795,885 A * 3/1974 Desso et al. ..... 439/67
4,068,912 A * 1/1978 Hudson et al. ..... 439/405
4,668,039 A * 5/1987 Marzili ..... 439/404
4,715,827 A * 12/1987 Furman ..... 439/465
5,118,306 A * 6/1992 Bixler et al. ..... 439/405
5,338,221 A * 8/1994 Bowen et al. ..... 439/405

FOREIGN PATENT DOCUMENTS

| | | |
|---|---|---|
| DE | 34 05 126 A1 | 8/1985 |
| DE | 36 44 025 A1 | 6/1988 |
| DE | 42 29 778 A1 | 3/1994 |
| DE | 693 17 832 T2 | 11/1999 |
| WO | WO 93/08619 | 4/1993 |

* cited by examiner

*Primary Examiner*—Gary Paumen
*Assistant Examiner*—Edwin A. Leon
(74) *Attorney, Agent, or Firm*—Fulbright & Jaworski, LLP

(57) ABSTRACT

A cable strain relief device (1) for strain-relieving connection to a contact partner of at least one cable (2) which has at least one electrical lead (3), the at least one cable (2) having an attached extrusion-coated strain-relieving element (4) made of plastic, and the strain-relieving element (4) being attached by compression pins 7 or cement to the contact partner for strain relief.

15 Claims, 2 Drawing Sheets

CABLE STRAIN RELIEF DEVICE

CROSS-REFERENCE TO PRIOR APPLICATION

All priority rights as authorized by statute are claimed for this application from German Patent Application No. 102 41 650.8 filed on Sep. 9, 2002.

BACKGROUND OF THE INVENTION

1. Field of the Invention

The present invention relates to a device for strain-relieving connection of at least one cable to a contact partner, and more particularly to an electrical connector cable strain relief device including a strain-relieving element positioned about a cable having an electrical lead extending out from the strain-relieving element, and a non-circular cross section positioning pin also extending out from the strain-relieving element so that it can be compression fit in an opening in the contact partner.

2. Description of the Related Technology

Conventionally electrical leads of a cable are provided with contact elements such as sockets or plugs. After a socket and a plug have been joined, which results in electrical connections between the electrical leads attached to the socket and plug, it is known that there needs to be a way to prevent the resulting electrical connections from being disconnected due to naturally occurring external effects, such as especially from vibration. Environmentally caused tensile and compressive forces that may act on and be conveyed along the cables must not result in any breaking of the electrical connections provided by the joined socket and plug. Therefore it is known to provide the electrical leads associated with a socket and a plug with strain relief for the joined socket and plug electrical connections.

The same applies for the case in which the electrically conductive end of a lead of at least one cable is electrically connected to a contact partner, such as especially a contact partner on a circuit board. Here, again, it is known that environmentally produced stresses and strains should be relieved to protect and maintain the electrical connection (especially a solder joint between the electrical lead and a printed conductor laid out on the circuit board).

SUMMARY OF THE INVENTION

An object of the present invention is to provide a mechanism for providing stress and strain relief (hereafter strain relief) for electrical leads associated with electrical connections, including the situation of at least one cable being electrically connected to a contact partner. Further objects include providing an extremely effective mechanism with respect to strain relief and at the same time providing a mechanism that is economical to produce and simple to handle.

For the present invention at least one cable is extrusion-coated with a strain-relieving plastic element, and the strain-relieving element can be connected to a contact partner. This arrangement has several advantages. On the one hand the strain-relieving plastic element easily and economically can be produced by an injection molding process. Since there generally is an electrically insulating outer shell (jacket) coated on an electrical cable and this electrically insulating shell often is made of plastic, the strain-relieving element of the present invention can be adapted to form an intimate connection with this outer shell for example by form-fit or plastic-to-plastic adhesion so that an associated cable is reliably fixed in association with the strain-relieving element of the present invention. At the same time this strain-relieving element of the present invention makes it possible for not only a cable, but for example also several round cables or even a single flat strip cable to be fixed in association with this strain-relieving element for purposes of effecting strain relief to protect and preserve an electrical connection. Thus, for example several round cables can be inserted next to one another in an injection mold so that after the injection molding process is completed several round cables located parallel next to one another are also fixed with respect to their arrangement sequence. Before or after extrusion-coating of the cable or of several cables the electrical leads can be exposed by stripping the outer non-conductive shell(s). After an end area of at least one cable has been extrusion-coated with a strain-relieving element according to the present invention, an electrically conductive area of the electrical lead can be joined to a contact partner. Here especially the insertion of the end area of the electrical lead into an opening of a circuit board is possible, the opening can be located to be through a printed conductor on the circuit board and the electrically conductive end area of the electrical lead and the printed conductor can be electrically joined to one another by a soldering process. Before, after or simultaneously with the soldering process the strain-relieving element according to the present invention can be joined detachably or captively to the contact partner, especially the circuit board. After establishing this connection, by for example an adhesive connection between the strain-relieving element and the contact partner, at least one cable having a strain-relieved arrangement is appropriately located in association with the contact partner. Accordingly, environmentally caused tensile or compressive forces acting on the cable are routed via the strain-relieving element according to the present invention to a structure for the contact partner, e.g., the circuit board. These forces thus are isolated from the electrical connection.

While there can be a captive connection of the strain-relieving element of the present invention to a contact partner for example by an adhesive connection, the strain-relieving element also can be connected via snap connections, positioning pins, screw connections or the like to a contact partner. In general, therefore, many different mechanisms for detachable connection are possible. Holding the strain-relieving element according to the present invention, though, in, on or at the contact partner without vibratory movement or play is important.

BRIEF DESCRIPTION OF THE DRAWINGS

An embodiment of the present invention for a cable strain-relieving mechanism to which the invention however is not limited and to which differences therefrom may occur to one skilled in the art without departing from the scope of the invention is described below and explained using the figures, wherein.

DETAILED DESCRIPTION

Figure 1:
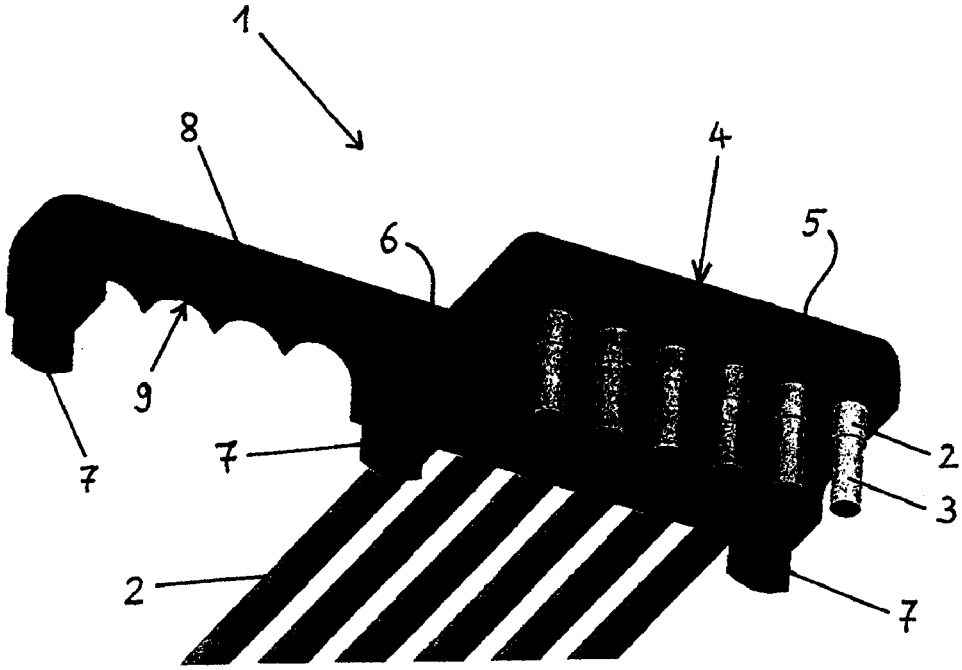
FIG. 1 shows a perspective bottom view of a cable strain relief device according to the present invention.

FIG. 1 shows a perspective bottom view of a cable strain relief device 1 for strain-relieving connection of at least one cable 2 which has at least one electrical lead 3. The cable 2 can be and is preferably a round cable having a plastic outer shell (outer jacket) that surrounds the electrical lead 3, preferably the electrical lead 3 includes stranded copper wires. The cable strain relief device 1 also can be used for other cable types (for example, flat cables or cables within which there are several electrical leads 3).

An aspect of the invention includes a strain-relieving element 4 that can be made of plastic which is located adjacent end areas of several cables 2 which run parallel and next to one another. This strain-relieving element 4 can be produced by an injection molding process in which a cable 2 is placed in a corresponding mold and is extrusion-coated with plastic. Since both the strain-relieving element 4 and also the outer shell of at least one cable 2 consist of plastic, they are able to form an intimate connection so that at least one cable 2 is fixed in position in the strain-relieving element 4.

For the embodiment of the cable strain relief device 1 which is shown in FIG. 1, the strain-relieving element 4 consists of an upper area 5 in which at least one cable 2 is fixed. Ends of the cables 2 are stripped to expose electrical leads 3 so that the electrical leads 3 project out from a bottom of the upper area 5. Furthermore the strain-relieving element 4 has a lower area 6 which is made somewhat in the shape of a crosspiece. On a bottom of the lower area 6 is at least one positioning pin 7. Advantageously, the positioning pin 7 is used for fixing the strain-relieving element 4 in a position over a contact partner that is not shown in FIG. 1. These positioning pins 7 fit into corresponding openings or holes in the contact partner. For example, the openings being made as holes in a circuit board (See FIG. 2). By this fitting of the positioning pins 7 into corresponding openings 12 the strain-relieving element 4, depending on its configuration, is connected detachably or captively to the contact partner 13, e.g., a circuit board, so that environmentally caused tensile or compressive forces acting on the cable(s) 2 are attenuated by the strain-relieving element 4 and can not act on end areas of the electrical leads 3 where electrical connections are made. The electrical connection, for example, can be made to an electrical conductor 15 positioned on a contact partner 13. An especially advantageous aspect for the positioning pins 7 is for them to have an angular, especially a triangular, cross section. Such triangular or other angular cross section shapes for positioning pins 7 provide that they then can be pressed into circular holes 12 of smaller diameter associated with a contact partner 13 so that all sharp edges of the angular cross section of the positioning pins 7 are compressed in the holes 12 and thus become somewhat blunt to match and be compressed in the round contours of the holes 12. For this embodiment of the present invention the strain-relieving element 4 can be dismounted from the contact partner 13; e.g., a circuit board, by a movement away from the circuit board, which can be upward, and this motion up can be prevented by a corresponding cover. In addition or alternatively to the positioning pins 7 it also is conceivable to cement the strain-relieving element 4 from the lower area 6 to an area on the contact partner 13, e.g., the circuit board.

Another available advantage of the strain-relieving element 4 consists in that after extrusion coating cable 2 with plastic, several such cables 2 can be fixed in parallel positions next to one another so that the end areas of the electrical leads 3 are arranged in a definable grid (order and distances from one another). Thus, for purposes of easier installation several cables 2 can be located next to one another and thus prefabricated as an assembly, with which handling and installation of several electrical connections are simplified.

In the embodiment of the present invention shown in FIG. 1, the upper area 5 of the strain-relieving element 4 and cables 2 are shown so that the cables 2 are bent at roughly right angles, as an alternative the cables 2 can be routed out of the strain-relieving element 4 at different angles. In this case for example only the upper area 5 of the strain-relieving element 4 would be present and the positioning pins 7 would be located on the end face of the upper area 5 so as to be parallel and next to or between the cables 2.

As another aspect of the invention, an arm 8 can be extended from the strain-relieving element 4. This arm 8 can have an end from which a positioning pin 7 can be extended. Between the end and the strain-relieving element 4 there can be recesses 9 which are pointed to be parallel to the positioning pin 7. These recesses 9 are shaped to correspond to the contours of other cables. Other cables not shown can be routed over a contact partner 13 or circuit board and through the recesses 9 formed on the arm 8.

Figure 2:
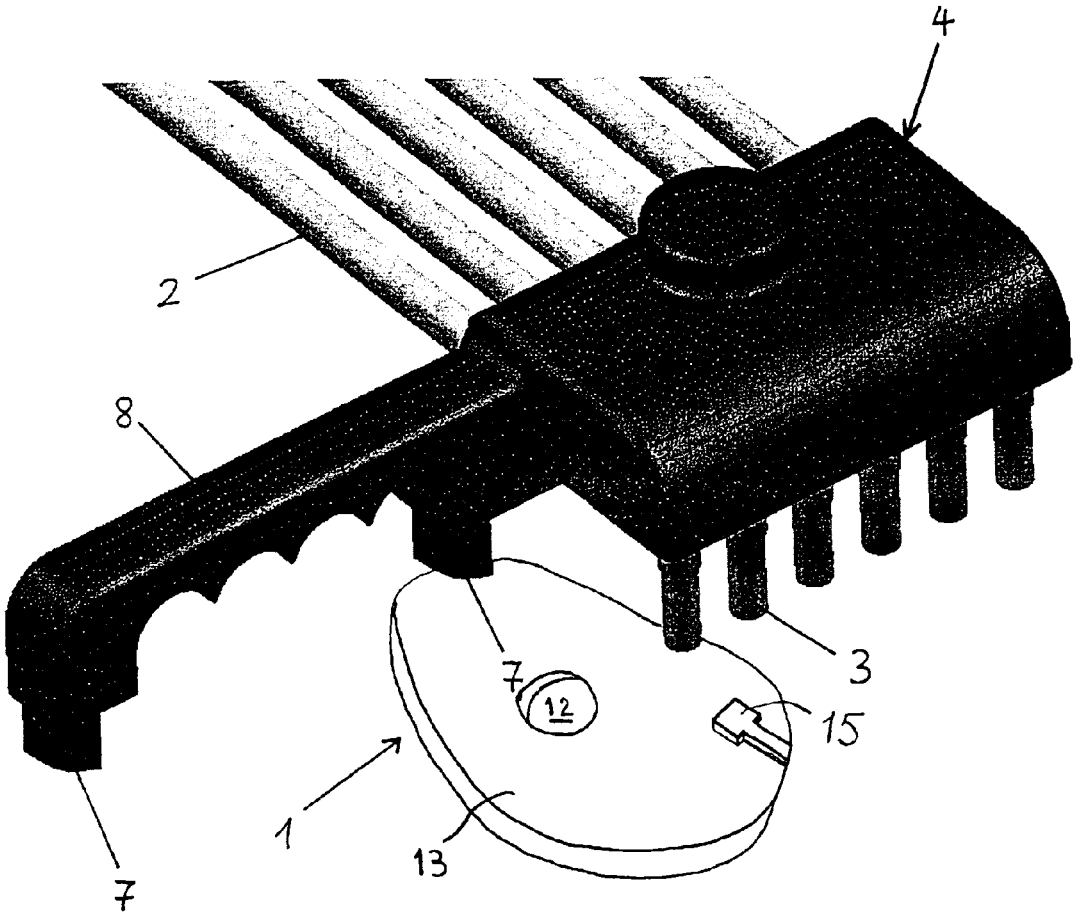
FIG. 2 shows a perspective top view of the cable strain relief device shown in FIG. 1, along with a shown partial perspective view of a contact partner with electrical conductor and hole.

FIG. 2 shows the strain-relieving device 1 in a top perspective view. Again, it is shown that several cables 2 can be fixed next to one another by the strain-relieving element 4 so that installation and manufacture of several electrical connections located next to one another are simplified.

Figure 3:
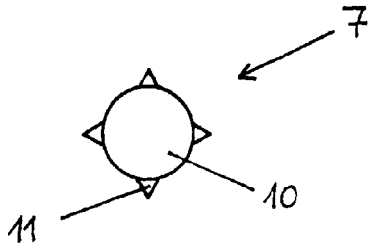
FIG. 3 shows an end view of a positioning pin for the cable strain relief device shown in FIGS. 1 and 2.

FIG. 3 shows a positioning pin 7 in a cross section view different from that which was shown in FIGS. 1 and 2. In particular, FIG. 1 shows positioning pins 7 that have a somewhat triangular cross section, the individual side surfaces of the triangle being sloped. In contrast, in FIG. 3 a different embodiment for a positioning pin 7 is shown. Here a pin body 10 is shown as being central to a positioning pin 7. This shown pin body 10 has a round cross section. On the surface of the pin body 10 are shown pin clips 11 which are made lengthwise to extend parallel to a longitudinal axis of positioning pin 7. The pin clips 11 can have a triangular or other cross section shapes. By inserting the positioning pin 7 extending from the strain-relieving element 4 into the corresponding openings 12, especially openings 12 in a circuit board 13, the pin clips 11 are plastically deformed under pressure in these openings 12 and thus the deformed positioning pins 7 prevent the strain-relieving element 4 from being unintentionally removed from the associated contact partner 13. While it is shown in FIG. 3 that the pin body 10 has four pin clips 11, it is feasible to use at least one pin clip 11. Alternatively, it is feasible to use a three pin clip 11 arrangement. Such a positioning pin 7 configuration can be easily produced and three pin clips 10 are enough to secure a strain-relieving element 4 with a circuit board. Moreover, a three pin clip 11 configuration can provide a centering function and moreover offer especially good strain relief when the pin body 10 between two of the pin clips 11 contacts an edge area of a corresponding opening 12.

When ambient caused tension or compressive forces act on the strain-relieving element 4, the pin clips 11 can be deformed to such a degree that the pin body 10 comes to rest on an edge area of a corresponding opening 12 in order to thus increase the strain-relieving action since the acting ambient forces no longer are exclusively absorbed by the pin clips 11, but instead are transmitted to the more solid pin body 10.

An available application for the cable strain relief device 1 is in association with High Frequency (HF) cables, power supply and ground cables for antenna amplifiers for motor vehicles, e.g., passenger cars. These possible applications do not constitute any limitation on use of the cable strain relief device 1 according to the present invention. It further is pointed out that the strain-relieving element 4 can be assembled from two or more parts.

What is claimed is:

1. An electrical connection cable strain relief device comprising:

a strain-relieving element disposed about a portion of at least one cable having at least one electrical lead extending out from said strain-relieving element;

at least one positioning pin disposed to extend from said strain-relieving element, said at least one positioning pin having a longitudinal axis parallel to a longitudinal axis for said electrical lead extending out from said strain-relieving element, and said at least one positioning pin having a non-circular cross section; and a contact partner including at least one hole disposed through a portion of said contact partner, said at least one hole having an inside wall sized so that said at least one positioning pin is compression fit in said at least one hole by the non-circular cross section of said at least one positioning pin having at least one outside dimension along said longitudinal axis of said at least one positioning pin that is larger than a corresponding inside dimension of the wall of said at least one hole;

wherein at least one electrical conductor disposed on said contact partner can be attached for electrical connection to a portion of said at least one electrical lead extending out from said strain-relieving element.

2. The electrical connection cable strain relief device according to claim 1, wherein said strain-relieving element is made of plastic and is extension-coated on said at least one cable.

3. The electrical connection cable strain relief device according to claim 1, wherein said strain-relieving element is cemented to said contact partner.

4. The electrical connection cable strain relief device according to claim 1, wherein said at least one positioning pin has an angular cross section.

5. The electrical connection cable strain relief device according to claim 1, wherein said at least one positioning pin has a triangular cross section.

6. The electrical connection cable strain relief device according to claim 1, wherein said contact partner is a circuit board.

7. The electrical connection cable strain relief device according to claim 1, further comprising an arm disposed to extend from said strain-relieving element, said arm including recesses, each of said recesses disposed and sized to retain a cable.

8. The electrical connection cable strain relief device according to claim 1, further comprising an arm disposed to extend from said strain-relieving element, said arm including a second positioning pin having a non-circular cross section and further having a longitudinal axis parallel to said longitudinal axis for said electrical lead extending out from said strain-relieving element;

wherein said second positioning pin is disposed to be compression fit in a second hole disposed through a portion of said contact partner.

9. The electrical connection cable strain relief device according to claim 1, wherein said strain-relieving element is disposed about said at least one cable to have a longitudinal axis of said cable parallel to a longitudinal axis of said at least one electrical lead extending out from said strain-relieving element.

10. The electrical connection cable strain relief device according to claim 1, further comprising;

said at least one positioning pin including a pin body and at least one pin clip disposed to project from said pin body.

11. The electrical connection cable strain relief device according to claim 10, wherein said at least one pin clip has a triangular cross section.

12. An electrical connection cable strain relief device comprising:

a strain-relieving element disposed about a portion of at least one cable having at least one electrical lead extending out from said strain-relieving element;

at least one positioning pin disposed to extend from said strain-relieving element, said at least one positioning pin having a longitudinal axis parallel to a longitudinal axis for said electrical lead extending out from said strain-relieving element, said at least one positioning pin having a non-circular cross section, and said at least one positioning pin including a pin body and at least one pin clip disposed to project from said pin body; and a contact partner including at least one hole disposed through a portion of said contact partner, said at least one hole having an inside wall sized so that said at least one positioning pin is compression fit in said at least one hole by the non-circular cross section of said at least one positioning pin having at least one outside dimension along said longitudinal axis of said at least one positioning pin that is larger than a corresponding inside dimension of the wall of said at least one hole;

wherein at least one electrical conductor disposed on said contact partner can be attached for electrical connection to a portion of said at least one electrical lead extending out from said strain-relieving element and where said at least one electrical lead has a longitudinal axis that is parallel to the longitudinal axis of said at least one positioning pin.

13. The electrical connection cable strain relief device according to claim 12, wherein said at least one pin clip has a triangular cross section.

14. An electrical connection cable strain relief device comprising:

a strain-relieving element disposed about a portion of at least one cable having at least one electrical lead extending out from said strain-relieving element;

at least one positioning pin disposed to extend from said strain-relieving element, said at least one positioning pin having a longitudinal axis parallel to a longitudinal axis for said electrical lead extending out from said strain-relieving element, and said at least one positioning pin having a non-circular cross section;

an arm disposed to extend from said strain-relieving element, said arm including recesses, each of said recesses disposed and sized to retain a cable; and a contact partner including at least one hole disposed through a portion of said contact partner, said at least one hole having an inside wall sized so that said at least one positioning pin is compression fit in said at least one hole by the non-circular cross section of said at least one positioning pin having at least one outside dimension along said longitudinal axis of said at least one positioning pin that is larger than a corresponding inside dimension of the wall of said at least one hole;

wherein at least one electrical conductor disposed on said contact partner can be attached for electrical connection to a portion of said at least one electrical lead extending out from said strain-relieving element and where said at least one electrical lead has a longitudinal axis that is parallel to the longitudinal axis of said at least one positioning pin.

15. The electrical connection cable strain relief device according to claim 14, wherein said arm includes a second positioning pin having a non-circular cross section and said second positioning pin further having a longitudinal axis parallel to said longitudinal axis for said electrical lead extending out from said strain-relieving element, and said second positioning pin being disposed to be compression fit in a second hole disposed through a portion of said contact partner.

* * * * *